United States Patent [19]

Sugaya

[11] 4,235,211

[45] Nov. 25, 1980

[54] FUEL PRESSURE REGULATOR

[75] Inventor: Kazuyoshi Sugaya, Kariya, Japan

[73] Assignee: Nippondenso Co., Ltd., Kariya, Japan

[21] Appl. No.: 40,049

[22] Filed: May 17, 1979

[30] Foreign Application Priority Data

May 19, 1978 [JP] Japan ..... 53/60527

[51] Int. Cl.[3] ..... F02M 39/00

[52] U.S. Cl. ..... 123/511; 123/512; 137/506

[58] Field of Search ..... 123/136, 139 AV, 139 R, 123/139 AW, 139 AF; 137/506, 115

[56] References Cited

U.S. PATENT DOCUMENTS

| | | | |
|---|---|---|---|
| 2,858,842 | 11/1958 | Reis | 137/115 |
| 3,524,465 | 8/1970 | Sadler | 137/115 |
| 3,946,712 | 3/1976 | Hatz et al. | 123/139 AF |
| 4,111,173 | 9/1978 | Skinner | 123/139 AF |

FOREIGN PATENT DOCUMENTS

| | | | |
|---|---|---|---|
| 666124 | 7/1963 | Canada | 123/136 |

*Primary Examiner*—Ira S. Lazarus
*Assistant Examiner*—Magdalen Moy
*Attorney, Agent, or Firm*—Cushman, Darby & Cushman

[57] ABSTRACT

A fuel pressure regulator for use in a fuel injection system for an internal combustion engine has a housing defining therein a fuel passage having upstream and downstream ends connected to a main fuel supply conduit and a fuel return pipeline, respectively. The fuel supply conduit is connected with fuel injectors at points upstream of the fuel pressure regulator. A first valve is provided in the fuel passage at a point downstream of a restriction also provided in the fuel passage. A fuel chamber is provided in the fuel passage between the restriction and the first valve. The first valve is opened when the fuel pressure in the fuel chamber exceeds a first predetermined pressure level to allow the fuel to flow from the fuel chamber to the return pipeline. A bypass fuel passage bypasses the restriction and has its downstream end connected to the fuel chamber. A second valve is provided in the bypass passage and is opened when the fuel pressure in the upstream end of the fuel passage exceeds a second predetermined pressure level higher than the first predetermined pressure level to allow the fuel to flow through the bypass passage.

4 Claims, 3 Drawing Figures

FUEL PRESSURE REGULATOR

BACKGROUND OF THE INVENTION

1. Field of the Invention

The present invention relates to a fuel pressure regulator for use in a fuel injection system for an internal combustion engine in which a liquid fuel is supplied under pressure through a main fuel conduit and through fuel injectors into the engine.

2. Description of the Prior Art

In a conventional fuel injection system for an internal combustion engine, a liquid fuel is pumped by an electrically operated constant-delivery type fuel pump and flows through a main fuel conduit to which are connected a plurality of branch conduits which respectively terminate in electro-magnetically operated fuel injectors mounted on the engine. In general, the fuel pump is designed to discharge the fuel at a rate which is from 2 to 3 times of the fuel consumption rate of the engine.

The fuel injection system has a fuel pressure regulator disposed in the main fuel conduit at its downstream end, i.e., downstream of the connections between the main fuel conduit and the branch conduits. Because of the large capacity of the fuel pump as compared with the actual fuel consumption rate of the associated engine, the fuel pressure regulator is required to deal with a return flow of the fuel at a very high rate and, thus, is inevitably large-sized and of a heavy weight.

In addition, the fuel pressure regulator is also required not only to maintain the fuel pressure in the main fuel conduit at a substantially constant pressure level irrespective of any change in the rate of the fuel flow therethrough, but also to ensure that the fuel residual or left in the main fuel conduit after the fuel pump is stopped is kept at a certain pressure level. So as to comply with the second requirement, the fuel pressure regulator must be provided with a valve consisting of valve members which have been precisely worked and precisely assembled, which results in an increase in the cost of manufacture of the fuel pressure regulator.

SUMMARY OF THE INVENTION

The present invention has its object to provide an improved fuel pressure regulator which is small-sized and light-weighted, can be manufactured at a low cost and provides a highly reliable operation.

In accordance with the present invention, there is provided a fuel pressure regulator for use in a fuel injection system for an internal combustion engine which system is of the type in which a fuel is supplied by a fuel pump from a fuel tank through a main fuel conduit and through fuel injectors into the engine and a part of the fuel supply by said pump is returned through a return pipeline to said fuel tank to regulate the fuel pressure at which the fuel is fed to said fuel injectors, said fuel regulator comprising:

an inlet connected to said main fuel conduit;

an outlet connected to said return pipeline;

a fuel passage extending between said inlet and outlet; said fuel passage including a fuel chamber therein;

a restriction means disposed in said fuel passage upstream of said fuel chamber;

a first valve member disposed in said fuel passage between said fuel chamber and said outlet and being movable to an open position when the fuel pressure in said fuel chamber exceeds a first predetermined pressure level, to allow the fuel to flow from said fuel chamber to said outlet and thus into said return pipeline;

a bypass passage extending in bypassing relationship to said restriction means and having a downstream end open said fuel chamber; and a second valve member disposed in said bypass passage and being movable to an open position when the fuel pressure in said inlet exceeds a second predetermined pressure level higher than said first predetermined pressure level, to allow the fuel to flow from said inlet through said bypass passage to said fuel chamber and to said outlet whereby the fuel pressure in said inlet is kept substantially at said second predetermined pressure level.

The above and other objects, features and advantages of the present invention will be made more apparent by the following description with reference to the accompanying drawings.

DESCRIPTION OF A PREFERRED EMBODIMENT

Figure 1:
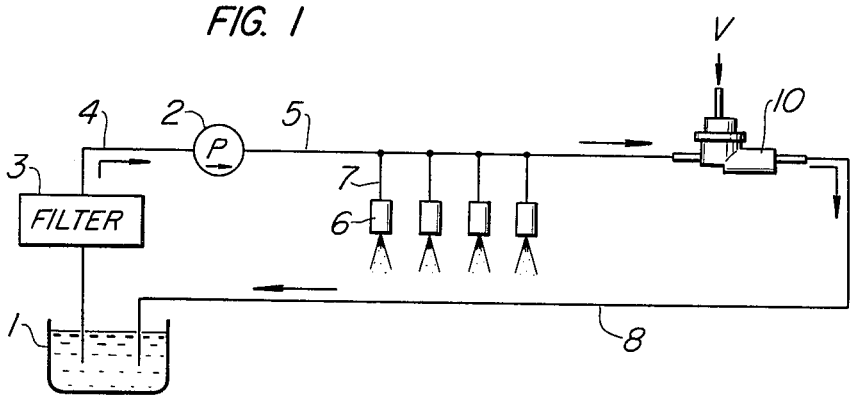
FIG. 1 is a diagrammatic illustration of a fuel injection system for an internal combustion engine in which the fuel pressure regulator according to the present invention is incorporated.

Referring first to FIG. 1, a liquid fuel is pumped by a fuel pump 2 from a fuel tank 1 through a fuel pipeline 4 in which a fuel filter 3 is provided. The fuel pump 2 discharges the fuel into a main fuel conduit 5 to which are connected a plurality of branch conduits 7 which respectively terminate in electromagnetically operated fuel injectors 6 which are mounted on a fuel injection type internal combustion engine (not shown). A fuel pressure regulator 10 according to the present invention is provided at the downstream end of the main fuel conduit 5, i.e., at a point downstream of the connection between the main fuel conduit 5 and the most downstream branch conduit 7. The fuel pressure regulator 10 is operative to control the return flow of fuel through a return pipeline 8 extending between the fuel pressure regulator 10 and the fuel tank 1, for thereby regulating the fuel pressure at which the fuel is supplied to respective fuel injectors 6.

Figure 2:
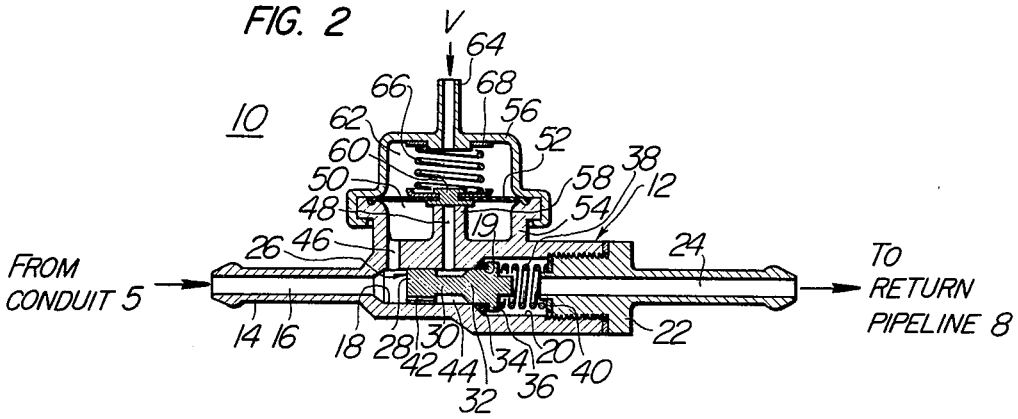
FIG. 2 is an enlarged sectional view of an embodiment of the fuel pressure regulator according to the present invention.

Referring to FIG. 2, the fuel pressure regulator 10 includes a housing 12 having an inlet port 14 which is adapted to be connected to the main fuel conduit 5 and which defines an inlet passage 16. The housing 12 defines therein a generally cylindrical bore 18 which is communicated at the upstream end with the downstream end of the inlet passage 16 and which is connected by an annular shoulder 19 to the upstream end of a generally cylindrical second bore 20 which is coaxial with the first bore 18 and which has a diameter larger than that of the first bore. The annular shoulder 19 provides an inclined or frusto-conical valve seat which is convergent to the first cylindrical bore 18. An outlet port member 22 is screwed into the downstream end of the second bore 20 and defines an outlet passage 24 to be connected to the return pipeline 8. A seal ring is interposed between the housing 12 and the outlet port member 22 to provide a fluid-tight seal therebetween.

A generally I-shaped, or in other words, a double-headed, valve member 26 is disposed partly in the first cylindrical bore 18 and partly in the second cylindrical bore 20. More specifically, the valve member 26 has a first head 28 which is snugly and slidably received in the first cylindrical bore 18. The first head 28 is connected by a reduced-diameter portion 30 to a second head 32 of such a diameter as to be snugly and slidably received in the first cylindrical bore 18. An "O" ring 34 is mounted on and extends around the second head 32. The second head 32 has a radially outwardly extending annular flange 36 of a diameter larger than that of the first cylindrical bore 18. The flange 36 is disposed in the second cylindrical bore 20 and resiliently biased toward the annular valve seat 19 by a compression coil spring 38 disposed in the second bore 20 between the flange 36 and the inner end of the outlet port member 22, so that the "O" ring 34 is adapted to be moved into sealing engagement with the annular valve seat 19. An annular shim 40 is interposed between the outlet port member 22 and the mating end of the compression spring 38 to initially adjust the force of the spring 38 acting on the valve member 26.

The first head 28 of the valve member 26 defines therein a fixed restriction passage 42 which communicates the inlet passage 16 with an annular fuel chamber 44 defined by the cooperation of the inner peripheral surface of the first cylindrical bore 18 and the first and second heads 28 and 32 and the reduced-diameter portion 30 of the valve member 26.

The fuel pressure regulator 10 is provided with a passage which bypasses the restriction passage 42 formed in the first head 28 of the valve member 26. The bypass passage is constituted by a first lateral passage 46 formed in the housing 12 in communication with the first cylindrical bore 18 adjacent to the inlet passage 16, a second lateral passage 48 formed in the housing 12 in communication with the annular fuel chamber 44, and a pressure chamber 50 defined by the cooperation of a generally cup-shaped portion 54 of the housing 12 and a diaphragm 52 having a peripheral edge portion cramped between an annular end face of the cup-shaped portion 54 of the housing 12 and a cup-shaped diaphragm casing 56 having its open end mechanically connected to an annular flange or lip portion provided around the mouth of the cup-shaped portion 54 of the housing 12. The second lateral passage 48 has its upstream end formed in a tubular projection 15 extending from the housing 12 and disposed substantially centrally of the pressure chamber 50. The diaphragm 52 carries a second valve member 60 which is disposed in opposite relationship to an annular second valve seat provided by an annular end face of the tubular projection 58. The diaphragm 52 cooperates with the diaphragm casing 56 to define a vacuum chamber 62 which is pneumatically communicated through a vacuum port 64 with an intake manifold of an associated internal combustion engine (not shown) so that the vacuum chamber 62 is supplied with the engine manifold vacuum as indicated by an arrow V in FIG. 2. A second compression coil spring 66 is disposed in the vacuum chamber 62 between the diaphragm casing 56 and the diaphragm 52 to bias the diaphragm 52 and thus the valve member 60 toward the valve seat provided by the tubular projection 58. A second shim 68 is interposed between the casing 56 and the adjacent end of the second spring 66 to initially adjust the force of the spring acting on the diaphragm 52. The valve member 60 mounted on the diaphragm 52 is operative to regulate the pressure of the fuel dependent on the engine intake vacuum V. For this purpose, the valve member 60 can be moved out of engagement with the annular end face of the tubular projection 58 so that the fuel flows from the first cylindrical bore 18 to the fuel chamber 44 through the bypass passage, i.e., through the first lateral passage 46, the pressure chamber 50 and the second lateral passage 48.

The operation of the fuel pressure regulator 10 will then be described hereunder. The fuel consumption of the engine is determined by the rate of the injection of the fuel by the injectors 6. The fuel pump 2 is designed to be of a capacity to discharge the fuel at a rate which is as high as from 2 to 3 times of the engine fuel consumption rate to ensure that, even when a void is produced in the fuel in the main fuel conduit 5 because of a high temperature within an engine compartment of a motor car on which the engine is mounted, such a void can promptly be eliminated. Thus, the regulator 10 is required to deal with a large amount of fuel. However, the part of the fuel flow which must be actually precisely regulated by the regulator 10 is of a range from $\frac{1}{2}$ to $\frac{1}{3}$ of the whole of the fuel flow. Assuming that the fuel enters through the inlet passage 16 into the first cylindrical bore 18, the fuel flows through the restriction passage 42 into the fuel chamber 44. When the fuel pressure in the fuel chamber 44 exceeds a first predetermined pressure level $P_1$ which is determined by the compression spring 38, the valve member 26 is moved rightwards as viewed in FIG. 2 against the spring 38 so that the "O" ring 34 is moved out of sealing engagement with the annular valve seat 19 to allow the fuel to flow from the fuel chamber 44 into the second cylindrical bore 20 and thus into the return pipeline 8 shown in FIG. 1.

Figure 3:
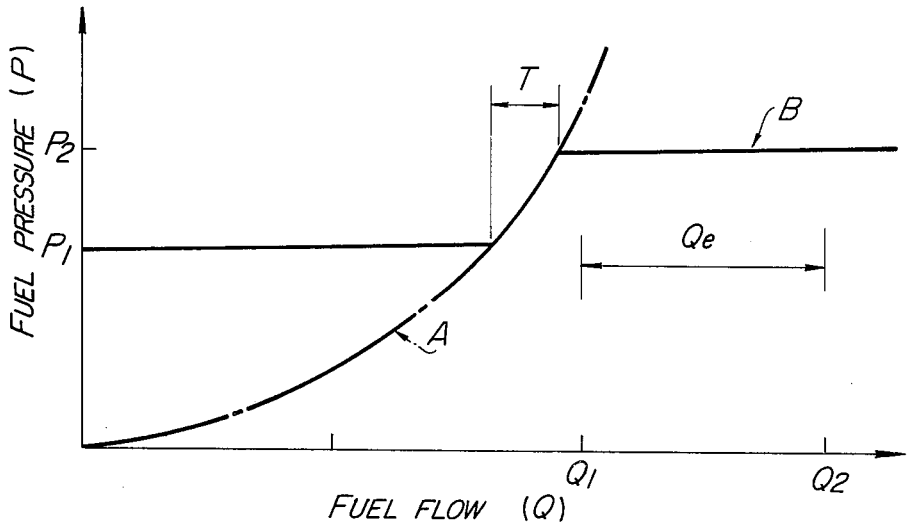
FIG. 3 graphically illustrates the operational characteristic of the pressure regulator shown in FIG. 2.

The operation characteristic of the restriction passage 42, i.e., the flow of fuel Q through the inlet passage 16 relative to the fuel pressure P in this passage 16, is as shown by a broken line A in FIG. 3. When the valve member 26 is moved to its open position and as the fuel flow through the inlet passage 16 is increased, the fuel pressure in the inlet passage 16 is raised as shown by the part of a solid line in the range T. For this reason, the fuel pressure in the pressure chamber 50 is also raised and, when the fuel pressure in the chamber 50 exceeds a predetermined pressure level $P_2$, the diaphragm 52 is deformed upwardly as viewed in FIG. 2 against the action of the compression spring 66 to move the valve member 60 away from the annular valve seat provided by the tubular projection 58. Thus, the fuel flows from the first cylindrical bore 18 through the bypass passage, i.e., through the first lateral passage 46, the pressure chamber 50 and the second lateral passage 48 into the fuel chamber 44 to the second cylindrical bore 20 and thus to the return pipeline 8. The degree of the opening of the valve member 60 is dependent both upon the pressure of the fuel in the pressure chamber 50 and upon the vacuum in the vacuum chamber 62. The fuel in the inlet passage 16 and, hence, in the main fuel conduit 5, is kept at a constant fuel pressure $P_2$ within the fuel flow range $Q_e$ as shown by a solid line B in FIG. 3. In other words, the fuel pressure in the inlet passage 16 is regulated and kept at a constant pressure level $P_2$ irrespective of an increase in the fuel flow from $Q_1$ to $Q_2$.

As described, the pressure regulation valve constituted by the valve member 60 carried by the diaphragm 52 is required to be operative only within the fuel flow range $Q_e$ in which the engine fuel consumption rate falls. Thus, the pressure regulation valve is required to be operative only within a limited range of the fuel flow. Accordingly, the pressure regulation valve can be of a reduced size to provide a highly reliable pressure regulating performance.

The fuel flow range within which the pressure regulation valve 60 must be operative to regulate the fuel pressure may be set as follows: The minimum fuel flow (VQ) through the pressure regulation valve is given by:

$$VQ = Q_p - Q_m$$

where $Q_p$ represents the discharge of the pump 2; and $Q_m$ represents the maximum engine fuel consumption.

Thus, the size of the restriction passage 42 may be determined such that, when the fuel is supplied into the engine at the maximum engine fuel consumption rate, the fuel pressure in the inlet passage 16 is equal to the pressure level $P_2$ at which the pressure regulation valve 60 is open.

When an engine switch is turned off to discontinue the engine operation, the operation of the pump 2 is interrupted with a resultant pressure drop within the main fuel conduit 5. Thus, the pressure regulation valve 60 is moved to its closed position, which is followed by a movement of the valve member 26 to its closed position in which the "O" ring 34 is in sealing engagement with the frusto-conical valve seat 19 so that the fuel residual in the fuel conduit 5 is maintained at a pressure level which is substantially equal to the first predetermined level $P_1$. This facilitates an easy re-start of the engine operation.

A preferred embodiment of the invention has been described above. In the manufacture of a practical fuel pressure regulator, substantially all of the components thereof may be made of materials such as iron-based alloys, plastic materials or nonferrous metals. To make the housing 12, the diaphragm casing 56 and the output port member 22 from a plastic material or materials would be most advantageous in that the weight of the regulator is minimized and the cost of manufacture is reduced. In such case, the plastic components 12, 22 and 56 may conveniently be adhesively secured together.

As described above, the pressure regulation valve of the fuel pressure regulator according to the present invention is required to be operative within only a limited range of the fuel flow and thus can advantageously be small-sized and light-weighted. The fuel pressure regulator of the invention employs two separate valve members, one for the regulation of the fuel pressure and the other for maintaining the residual fuel in the main fuel conduit at a predetermined pressure level. The employment of these two separate or independent valve members is effective not only to assure highly reliable valve operations but also to eliminate precision working of these and other related structural components for thereby greatly reducing the cost of manufacture of the fuel pressure regulator.

What is claimed is:

1. A fuel pressure regulator for use in a fuel injection system for an internal combustion engine, of the type in which a fuel is supplied under pressure from a fuel source through a main fuel conduit and through fuel injectors into the engine and an excess part of the fuel supply is returned from the main fuel conduit through a return pipeline to said fuel source, said fuel pressure regulator comprising:

a housing defining therein a fuel passage having an upstream end adapted to be communicated with said main fuel conduit and a downstream end adapted to be communicated with said return pipeline;

said fuel passage including a substantially cylindrical first part, a substantially cylindrical second part disposed downstream of said first part in substantially coaxial relationship thereto, said second part having a diameter greater than that of said first part, and an annular shoulder interconnecting said first and second parts and forming a first valve seat;

an axially elongated double-headed first valve member including first and second heads formed at the upstream and downstream ends and connected by an intermediate portion of a reduced diameter;

said first head defining therein a restriction passage and being snugly and slidably disposed in said first cylindrical part of said fuel passage;

said second head having a substantially cylindrical portion which can be slidably and snugly received in said first cylindrical part of said fuel passage and a substantially annular portion which extends radially outwardly from said cylindrical head portion and is disposed in said second cylindrical part of said fuel passage;

a compression spring disposed in said second cylindrical part of said fuel passage to bias said first valve member toward the upstream end of said fuel passage so that said annular portion of said second head of said valve member is moved into sealing engagement with said first valve seat;

the inner peripheral surface of said first cylindrical part of said fuel passage cooperating with said first valve member to define an annular fuel chamber which is always communicated through said restriction passage with the upstream end of said fuel passage;

said first valve member being movable to its open position when the fuel pressure in said fuel chamber exceeds a predetermined pressure level determined by said compression spring, to allow the fuel to flow from said fuel chamber to said second cylindrical part of said fuel passage and into said return pipeline;

means defining a bypass fuel passage bypassing said restriction passage and having a downstream end connected to said fuel chamber, said bypass fuel passage including a second valve seat disposed between the upstream and downstream ends thereof;

said bypass fuel passage defining means including a diaphragm carrying a second valve member disposed in opposite relationship to said second valve seat;

said diaphragm being operative to move said second valve member away from said valve seat when the fuel pressure at said upstream end of said fuel passage exceeds a second predetermined pressure level higher than said first predetermined pressure level, to allow the fuel to flow from the upstream end of said fuel passage through said bypass passage to said fuel chamber and thus to said second cylindrical part of said fuel passage.

2. A fuel pressure regulator for use in a fuel injection system for an internal combustion engine which system is of the type in which a fuel is supplied by a fuel pump from a fuel tank through a main fuel conduit and through fuel injectors into the engine and a part of the fuel supply by said pump is returned through a return pipeline to said fuel tank to regulate the fuel pressure at which the fuel is fed to said fuel injectors, said fuel regulator comprising:

an inlet connected to said main fuel conduit;

an outlet connected to said return pipeline;

a fuel passage extending between said inlet and outlet; said fuel passage including a fuel chamber therein;

a restriction means disposed in said fuel passage upstream of said fuel chamber;

a first valve member disposed in said fuel passage between said fuel chamber and said outlet and being movable to an open position when the fuel pressure in said fuel chamber exceeds a first predetermined pressure level, to allow the fuel to flow from said fuel chamber to said outlet and thus into said return pipeline;

a bypass passage extending in bypassing relationship to said restriction means and having a downstream end open to said fuel chamber; and a second valve member disposed in said bypass passage and being movable to an open position when the fuel pressure in said inlet exceeds a second predetermined pressure level higher than said first predetermined pressure level, to allow the fuel to flow from said inlet through said bypass passage to said fuel chamber and to said outlet whereby the fuel pressure in said inlet is kept substantially at said second predetermined pressure level.

3. A fuel pressure regulator as claimed in claim 2, wherein said passage includes a valve seat provided downstream of said fuel chamber, and wherein said first valve member comprises a rod-like member having a portion adapted to be moved into and out of sealing engagement with said valve seat, said rod-like member being provided with an annular groove which cooperates with said passage to define said fuel chamber, said restriction means being in the form of a restriction passage formed in and extending through the part of said rod-like member between said annular groove and the upstream end thereof.

4. A fuel pressure regulator as claimed in claim 2 or 3, wherein said bypass passage includes a pressure chamber and a second valve seat disposed downstream of said pressure chamber, said pressure chamber being partly defined by a diaphragm, said second valve member being disposed in opposite relationship to said second valve seat and carried by said diaphragm for movement therewith, said diaphragm having one side exposed to the fuel pressure in said pressure chamber.

* * * * *